US009702232B2

(12) United States Patent
Fouillard et al.

(10) Patent No.: US 9,702,232 B2
(45) Date of Patent: Jul. 11, 2017

(54) ROD DRIVEN CENTRIFUGAL PUMPING SYSTEM FOR ADVERSE WELL PRODUCTION

(71) Applicants: Oilfield Equipment Development Center Limited, Victoria (SC); Weatherford/Lamb, Inc., Houston, TX (US)

(72) Inventors: Phil Fouillard, Sherwood Park (CA); Darren Part, St. Albert (CA); Evan Noble, Edmonton (CA)

(73) Assignees: OILFIELD EQUIPMENT DEVELOPMENT CENTER LIMITED, Mahe, Victoria (SC); WEATHERFORD/LAMB, INC., Houston, TX (US)

( * ) Notice: Subject to any disclaimer, the term of this patent is extended or adjusted under 35 U.S.C. 154(b) by 435 days.

(21) Appl. No.: 14/265,867

(22) Filed: Apr. 30, 2014

(65) Prior Publication Data

US 2014/0262259 A1 Sep. 18, 2014

Related U.S. Application Data

(63) Continuation-in-part of application No. 13/827,624, filed on Mar. 14, 2013, now Pat. No. 9,309,753.

(51) Int. Cl.

| | |
|---|---|
| ***E21B 43/12*** | (2006.01) |
| ***F04D 29/44*** | (2006.01) |
| *E21B 43/24* | (2006.01) |

(52) U.S. Cl.

CPC ..... *E21B 43/126* (2013.01); *F04D 29/445* (2013.01); *E21B 43/2406* (2013.01)

(58) Field of Classification Search

CPC ..... E21B 43/126; E21B 47/0006; E21B 47/0007; E21B 17/00; E21B 19/00

See application file for complete search history.

(56) References Cited

U.S. PATENT DOCUMENTS

| | | | |
|---|---|---|---|
| 2,171,171 | A | 8/1939 | Brauer |
| 5,160,240 | A | 11/1992 | Wilson |

(Continued)

FOREIGN PATENT DOCUMENTS

| | | | |
|---|---|---|---|
| CA | 2791650 | A1 | 4/2013 |
| WO | 2013185005 | A2 | 12/2013 |

OTHER PUBLICATIONS

Canadian Office Action for Application No. CA 2,850,954 dated Nov. 23, 2015.

(Continued)

*Primary Examiner* — Brad Harcourt

(74) *Attorney, Agent, or Firm* — Patterson & Sheridan LLP

(57) ABSTRACT

A downhole assembly of an artificial lift system includes: an adapter for connection to production tubing; a receptacle shaft; an up-thrust bearing; a centrifugal pump; and a down-thrust bearing. The receptacle shaft has a latch profile for receiving a latch fastener of a drive coupling and a torsional profile for mating with the coupling to longitudinally and torsionally connect thereto. The up-thrust bearing includes: a thrust driver longitudinally and torsionally connected to the receptacle shaft; and a thrust carrier connected to the adapter. The centrifugal pump includes: a diffuser connected to the adapter; a pump shaft torsionally connected to the receptacle shaft; and an impeller connected to the pump shaft. The down-thrust bearing includes: a thrust driver longitudinally and torsionally connected to the pump shaft; and a thrust carrier connected to the adapter.

20 Claims, 6 Drawing Sheets

(56) References Cited

U.S. PATENT DOCUMENTS

| | | | | |
|---|---|---|---|---|
| 5,573,063 | A | 11/1996 | Morrow | |
| 6,388,353 | B1 | 5/2002 | Liu et al. | |
| 6,708,759 | B2 | 3/2004 | Leaute et al. | |
| 6,708,763 | B2 | 3/2004 | Howard et al. | |
| 7,255,165 | B2 | 8/2007 | Abdo et al. | |
| 7,793,717 | B2 | 9/2010 | Davison | |
| 7,854,259 | B2 | 12/2010 | Davison | |
| 7,874,369 | B2 | 1/2011 | Parker et al. | |
| 7,896,624 | B2 | 3/2011 | Dass | |
| 8,215,387 | B1 | 7/2012 | Weiers et al. | |
| 8,272,434 | B2 | 9/2012 | Garcia | |
| 8,336,632 | B2 | 12/2012 | Morrow et al. | |
| 2005/0047944 | A1 | 3/2005 | Howard | |
| 2005/0061517 | A1* | 3/2005 | Wittrisch | E21B 43/128 166/369 |
| 2009/0314499 | A1 | 12/2009 | Bussear et al. | |
| 2010/0098563 | A1* | 4/2010 | Liu | F04C 14/08 417/410.3 |
| 2010/0155076 | A1 | 6/2010 | Scarsdale et al. | |
| 2010/0319904 | A1 | 12/2010 | Morrow | |
| 2011/0052418 | A1 | 3/2011 | Morrow | |
| 2012/0237380 | A1 | 9/2012 | Robles-Villa | |
| 2013/0105156 | A1 | 5/2013 | Bara et al. | |
| 2013/0330211 | A1 | 12/2013 | Morrow | |
| 2014/0196881 | A1 | 7/2014 | Morrow | |
| 2014/0196882 | A1 | 7/2014 | Morrow | |
| 2014/0196886 | A1 | 7/2014 | Morrow | |
| 2014/0290966 | A1 | 10/2014 | Morrow et al. | |

OTHER PUBLICATIONS

Patterson, John C. et al.—Paper entitled "The Geared Centrifugal Pump—Project Update" prepared for presentation at the 2011 Society of Petroleum Engineers, Gulf Coast Section Electric Submersible Pump Workshop, held in The Woodlands, Texas, Apr. 29 to May 1, 2009.

Patterson, John C. et al.—Paper entitled "The Geared Centrifugal Pump—a New High-Volume Lift System" prepared for presentation at the 2011 Society of Petroleum Engineers, Gulf Coast Section Electric Submersible Pump Workshop, held in The Woodlands, Texas, Apr. 25-29, 2011.

U.S. Appl. No. 13/827,624.

* cited by examiner

ROD DRIVEN CENTRIFUGAL PUMPING SYSTEM FOR ADVERSE WELL PRODUCTION

BACKGROUND OF THE DISCLOSURE

Field of the Disclosure

The present disclosure generally relates to a rod driven centrifugal pumping system for adverse well production.

Description of the Related Art

One type of adverse well production is steam assisted gravity drainage (SAGD). SAGD wells are quite challenging to produce. They are known to produce at temperatures above two hundred degrees Celsius. They are typically horizontally inclined in the producing zone. The produced fluids can contain highly viscous bitumen, abrasive sand particles, high temperature water, sour or corrosive gases and steam vapor. Providing oil companies with a high volume, highly reliable form of artificial lift is greatly sought after, as these wells are quite costly to produce due to the steam injection needed to reduce the in-situ bitumen's viscosity to a pumpable level.

For the last decade, the artificial lift systems deployed in SAGD wells have typically been Electrical Submersible Pumping (ESP) systems. Although run lives of ESP systems in these applications are improving they are still well below "normal" run times, and the costs of SAGD ESPs are three to four times that of conventional ESP costs.

SUMMARY OF THE DISCLOSURE

The present disclosure generally relates to a rod driven centrifugal pumping system for adverse well production. In one embodiment, a downhole assembly of an artificial lift system includes: an adapter for connection to production tubing; a receptacle shaft; an up-thrust bearing; a centrifugal pump; and a down-thrust bearing. The receptacle shaft has a latch profile for receiving a latch fastener of a drive coupling and a torsional profile for mating with the coupling to longitudinally and torsionally connect thereto. The up-thrust bearing includes: a thrust driver longitudinally and torsionally connected to the receptacle shaft; and a thrust carrier connected to the adapter. The centrifugal pump includes: a diffuser connected to the adapter; a pump shaft torsionally connected to the receptacle shaft; and an impeller connected to the pump shaft. The down-thrust bearing includes: a thrust driver longitudinally and torsionally connected to the pump shaft; and a thrust carrier connected to the adapter.

In another embodiment, a method of pumping production fluid from a wellbore includes landing a drive string onto a shaft of a downhole assembly disposed in the wellbore and fastening the drive string to the shaft. The downhole assembly includes a tension chamber, a centrifugal pump, and a thrust chamber. The method further includes pumping production fluid from the wellbore by: operating a motor of a drive head at surface, thereby rotating the drive string at a speed greater than or equal to 800 RPM and driving an impeller of the centrifugal pump; and operating a tensioner of the drive head to exert tension on the drive string, thereby stabilizing the drive string.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
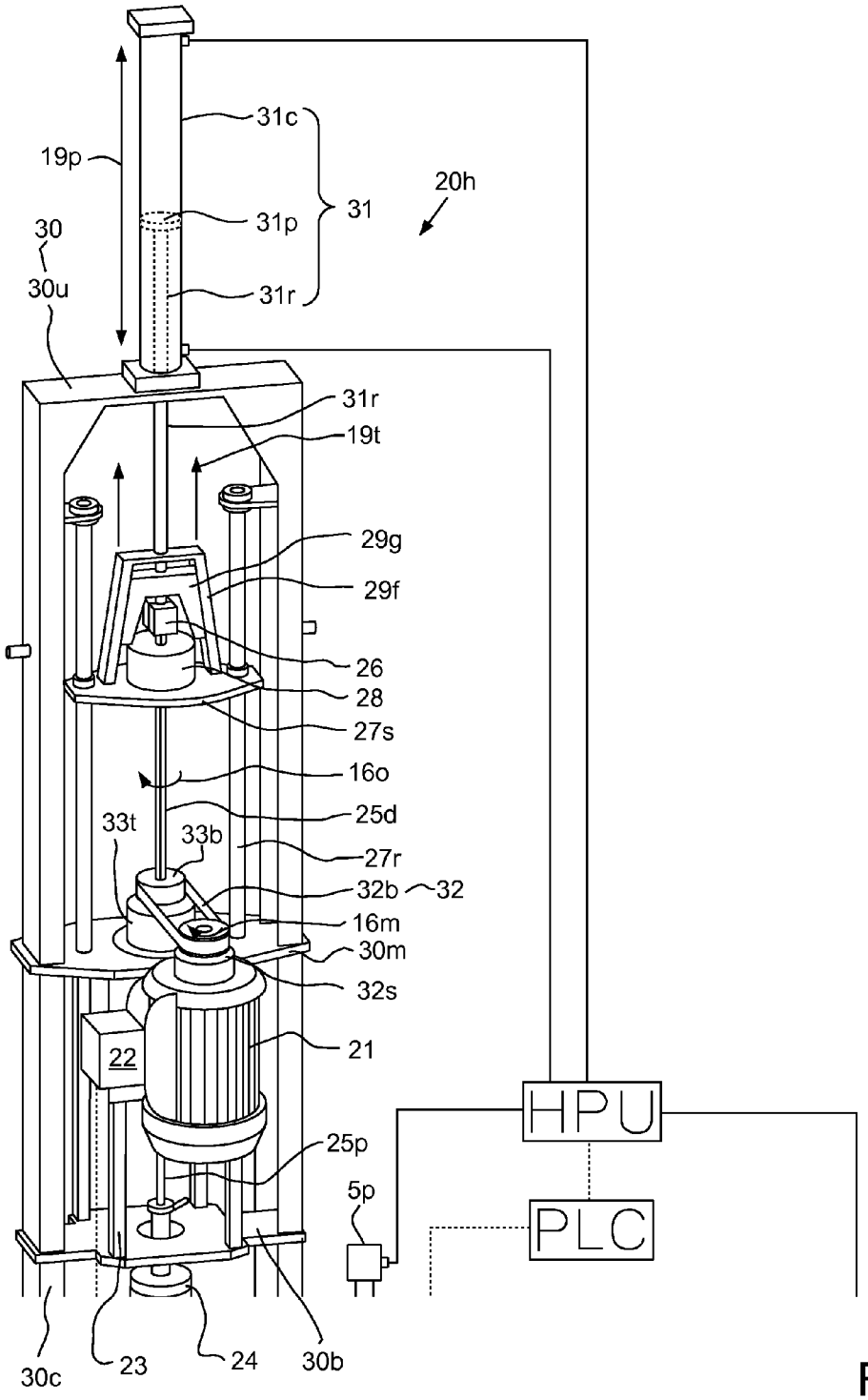
FIGS. 1A and 1B illustrate an artificial lift system (ALS) pumping production fluid from a steam assisted gravity drainage (SAGD) well, according to one embodiment of the present disclosure.
Figure 1B:
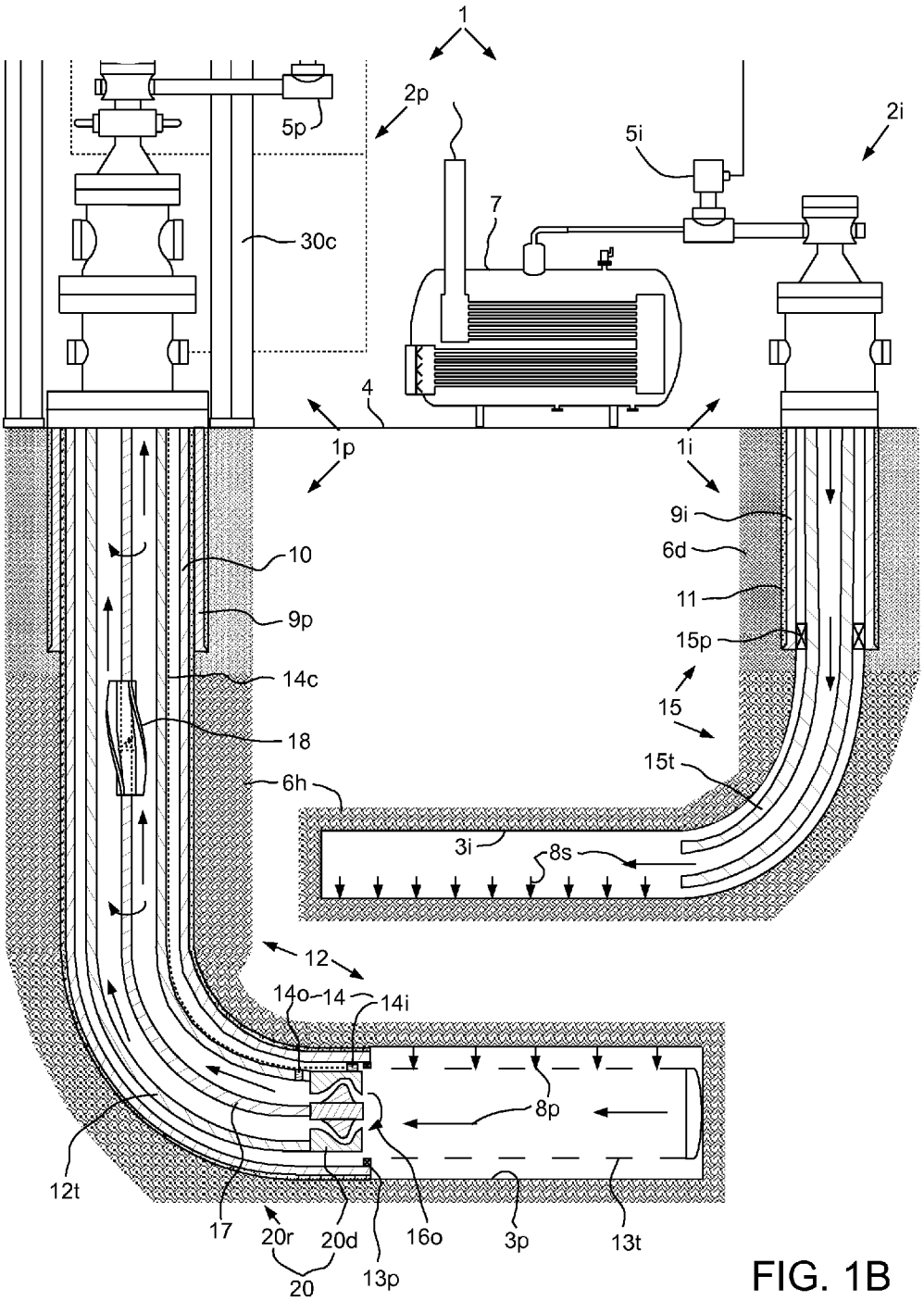

FIGS. 1A and 1B illustrate an artificial lift system (ALS) 20 pumping production fluid, such as bitumen 8*p* (aka tar sand or oil sand), from a steam assisted gravity drainage (SAGD) well 1, according to one embodiment of the present disclosure. The ALS 20 may include a drive head 20*h*, a drive string 20*r*, and a downhole assembly 20*d*. The SAGD well 1 may include an injection well 1*i* and a production well 1*p*. Each well 1*i,p* may include a wellhead 2*i,p* located adjacent to a surface 4 of the earth and a wellbore 3*i,p* extending from the respective wellhead. Each wellbore 3*i,p* may extend from the surface 4 vertically through a non-productive formation 6*d* and horizontally through a hydrocarbon-bearing formation 6*h* (aka reservoir).

Alternatively, the production fluid may be heavy crude oil or oil shale. Alternatively the horizontal portions of either or both wellbores 3*i,p* may be other deviations besides horizontal. Alternatively, the wellheads 2*i,p* and vertical portions of either or both wellbores 3*i,p* may be deviated (aka slant well). Alternatively, the injection well 1*i* may be omitted and the ALS 20 may be used to pump production fluid from other types of adverse production wells, such as other types of high temperature wells.

Surface casings 9*i,p* may extend from respective wellheads 2*i,p* into respective wellbores 3*i,p* and each casing may be sealed therein with cement 11. The production well 1*p* may further include an intermediate casing 10 extending from the production wellhead 2*p* and into the production wellbore 3*p* and sealed therein with cement 11. The injection well 1*i* may further include an injection string 15 having an injection tubing string 15*t* extending from the injection wellhead 2*i* and into the injection wellbore 3*i* and having a packer 15*p* for sealing an annulus thereof.

A steam generator 7 may be connected to the injection wellhead 2*i* and may inject steam 8*s* into the injection wellbore 3*i* via the injection tubing string 15*t*. An injection rate of the steam 8*s* may be regulated by an injection control valve 5*i* operated by a programmable logic controller (PLC) via a hydraulic power unit (HPU). The injection wellbore 3*i* may deliver the steam 8*s* into the reservoir 6*h* to heat the bitumen 8*p* into a flowing condition as the added heat reduces viscosity thereof. The horizontal portion of the production wellbore 3*p* may be located below the horizontal portion of the injection wellbore 3*i* to receive the bitumen drainage 8*p* from the reservoir 6*h*.

Alternatively, vaporized solvent or a heated gas, such as carbon dioxide, may be injected into the injection wellbore 3*i* instead of the steam 8*s*. Alternatively, the injection wellbore 3*i* may extend to a natural gas formation an oxidant, such as air, may be injected into the injection wellbore for combustion thereof (aka in situ combustion). Alternatively, the injection well 1*i* may instead be an electrode well of an electro thermal dynamic stripping process. Alternatively, the injection well 1*i* may be omitted and cyclic steam stimulation (aka huff and puff), high pressure cyclic steam stimulation, pressure up and blow down, mixed well steam drive and drainage, liquid addition to steam for enhanced recovery of bitumen.

A production string 12 may extend from the production wellhead 2*p* and into the production wellbore 3*p*. The production string 12 may include a string of production tubing 12*t* and the downhole assembly 20*d* connected to a bottom of the production tubing. The production tubing 12*t* may be hung from the production wellhead 2*p* using a simple hanger (not shown) or a tubing rotator (not shown). If hung using a tubing rotator, the rotator may be operated to slowly rotate the production string 12 during operation of the ALS 20, thereby prolonging the life of the production tubing 12*t* in case that the drive string 20*r* rubs against the production tubing during operation thereof.

A slotted liner 13*t* may be hung 13*p* from a bottom of the intermediate casing 10 and extend into an open hole portion of the production wellbore 3*p*. The downhole assembly 20*d* may be located adjacent a bottom of the intermediate casing 10. An instrument string 14 may extend from the production wellhead 2*p* and into the production wellbore 3*p*. The instrument string 14 may include a cable 14*c* in data communication with the PLC and one or more sensors 14*i,o* in data communication with the cable. The sensors 14*i,o* may include an inlet 14*i* pressure and/or temperature sensor in fluid communication with the bitumen 8*p* entering the downhole assembly 20*d* and an outlet 14*o* pressure and/or temperature sensor in fluid communication with the bitumen discharged from the downhole assembly.

Figure 2A:
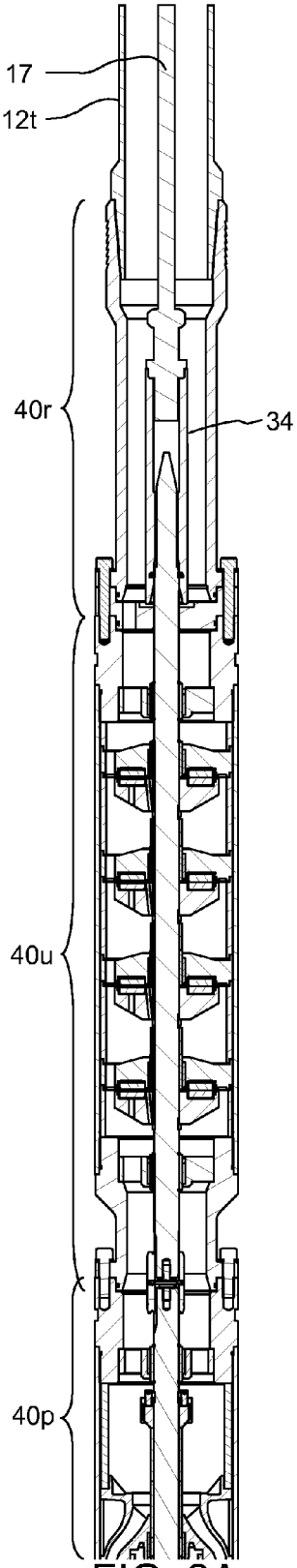
FIGS. 2A and 2B illustrate a downhole assembly of the ALS.
Figure 3A:
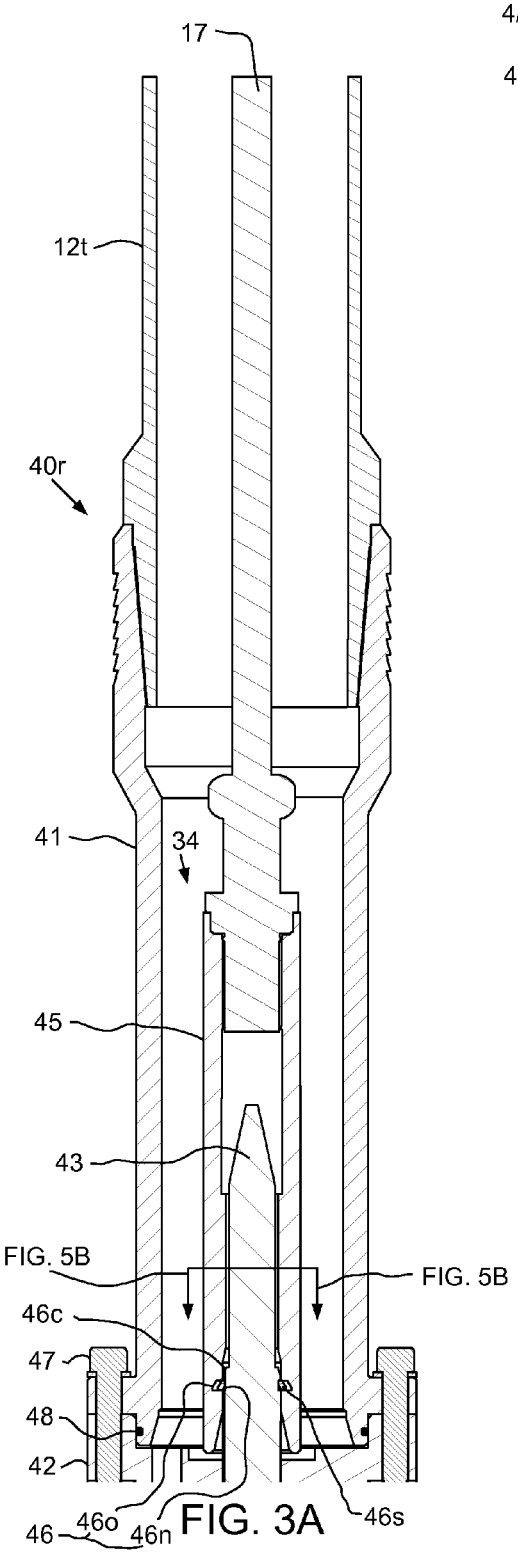
FIG. 3A illustrates a rod receptacle of the downhole assembly.

The drive string 20*r* may extend from the drive head 20*h*, through the production wellhead 2*p*, and into the production wellbore 3*p*. The drive string 20*r* may include a continuous sucker rod 17, a backspin retarder 18, a drive rod 25*d,p*, and a rod coupling 34 (FIGS. 2A and 3A). The drive rod 25*d,p* may connect to an upper end of the continuous sucker rod 17 and the rod coupling 34 may connect to a lower end of the continuous sucker rod, such as by threaded couplings. The drive string 20*r* may longitudinally and torsionally connect the drive head 20*h* to the downhole assembly 20*d* for operation thereof.

Alternatively, the downhole assembly 20*d* may be located within the slotted liner 13*t*. Alternatively, the drive string 20*r* may include a jointed sucker rod string (sucker rods and couplings), coiled tubing, or a drill pipe string instead of the continuous sucker rod 17.

The backspin retarder 18 may include a sleeve, a drag and a clutch. The sleeve may be fastened to an outer surface of the continuous sucker rod 17 to torsionally connect the sleeve thereto. The drag may be an impeller having vanes extending into an annulus formed between the continuous sucker rod 17 and the production tubing 12*t*. The clutch may be a pin and slot arrangement linking the impeller and the sleeve such that the sleeve may freely rotate relative to the impeller in response to upward flow of the bitumen 8*p* in the production tubing 12*t*. Should operation of the ALS 20 be interrupted, the downward flow of bitumen 8*p* may engage the clutch, thereby torsionally connecting the impeller and the sleeve. As the continuous sucker rod 17 backspins, the impeller may dampen the energy stored therein to control dissipation thereof.

Alternatively, the backspin retarder 18 may include a rod instead of a sleeve connecting upper and lower portions of the continuous sucker rod 17 or connecting the lower end of the continuous sucker rod to the rod coupling 34.

The drive head 20*h* may include a motor 21, a motor driver 22, a motor bracket 23, a stuffing box 24, a clamp 26, a stabilizer 27*r,s*, a thrust bearing 28, a linkage 29*f,g*, a frame 30, a tensioner 31, and transmission 32. The frame 30 may longitudinally and torsionally support the drive head 20*h* from a foundation. The frame 30 may include one or more vertical columns 30*c*, and one or more horizontal members, such as a top plate 30*u*, a mid base 30*m*, and a lower base 30*b*. The frame members 30*c,u,m,b* may be welded or fastened together. Alternatively, the frame 30 may support the drive head 20*h* from the wellhead 2*p*.

The motor 21 may be electric, such as a two-pole, three-phase, squirrel-cage induction type and may operate at a nominal rotational speed of thirty-five hundred revolutions per minute (RPM) at sixty Hertz (Hz). The motor driver 22 may be variable speed including a rectifier, a motor controller, and an inverter. The motor driver 22 may receive a three phase alternating current (AC) power signal from a three phase power source (not shown), such as a generator or transmission lines. The rectifier may convert the three phase AC power signal to a direct current (DC) power signal and the inverter may modulate the DC power signal into a three phase AC power signal at a variable frequency for controlling the rotational speed 16*m* of the motor 21. The PLC may supply the desired rotational speed 16*m* of the motor 21 to the motor controller. The motor rotational speed 16*m* may be less or substantially less than the nominal speed, such as between eight hundred and twenty-five hundred revolutions per minute (RPM) or between twelve hundred and fifteen hundred RPM.

A housing of the motor 21 may be connected to the motor bracket 23, such as by fasteners. The motor bracket 23 may be connected to the mid 30*m* and lower 30*b* bases. The transmission 32 may include a motor sheave 32*s* torsionally connected to a rotor of the motor 21, a rod sheave 33*b* torsionally connected to a profiled portion 25*d* of the drive rod 25*d,p*, a belt 32*b* linking the sheaves, and a turntable 33*t* for supporting the rod sheave from the mid base 30*m* while allowing rotation of the rod sheave relative thereto. The rod sheave 33*b* may have a profiled socket formed therethrough and the profiled portion 25*d* of the drive rod 25*d,p* may extend through the socket. Each of the profiled portion 25*d* and the socket have a torsional profile, such as splines and splineways or a polygonal shape, thereby torsionally connecting the drive rod 25*d,p* to the motor 21 while allowing longitudinal movement of the drive rod relative to the motor and frame 30. The transmission 32 may rotate the drive string 20*r* at a rotational speed 16*o* equal to the motor rotational speed 16*m*.

Alternatively, the motor 21 may be hydraulic or pneumatic. Alternatively, the motor 21 may be a brushless permanent magnet motor. Alternatively, the transmission 32 may include roller chain and sprockets or a gearbox. Alternatively, the drive head 20*h* may be direct drive (no transmission). Alternatively, the motor 21 may be operated at the nominal speed and the transmission 32 may reduce the drive speed 16*o*. Alternatively, the drive speed 16*o* may be greater than or equal to the nominal speed.

The stabilizer 27*r,s* may include a slider 27*s* and one or more (pair shown) guide rods 27*r*. A lower end of the guide rods 27*r* may be connected to the mid base 30*m* and an upper end of the guide rods may be connected to respective columns 30*c* by mounting lugs. The slider 27*s* may have sockets formed therethrough and the guide rods 27*r* may extend through the respective sockets, thereby torsionally connecting the slider to the frame 30 while allowing longitudinal movement of the slider relative thereto. The slider 27*s* may also carry the thrust bearing 28

The clamp 26 may be longitudinally connected to an upper end of the drive rod 25*d,p*, such as by fasteners. The thrust bearing 28 may include a housing, a thrust runner, and a thrust carrier. The housing may be longitudinally and torsionally connected to the slider 27*s* and have lubricant, such as refined or synthetic oil disposed therein. The thrust runner may be longitudinally coupled to the drive rod 25*d,p*, such as by having a landing shoulder receiving the clamp 26, and torsionally connected to the drive rod, such as by having a torsional profile formed in an inner surface thereof receiving the profiled portion 25*d*. The thrust carrier may be longitudinally and torsionally connected to the housing, such as by press fit. The thrust carrier may have two or more load pads formed in a face thereof adjacent the thrust runner for supporting weight of the drive string 20*r* and tension 19*t* exerted on the drive string by the tensioner 31.

The stuffing box 24 may be sealed with and connected to an upper end of the production wellhead 2*p*, such as by a flanged connection. A polished portion 25*p* of the drive rod 25*d,p* may extend through the stuffing box. The stuffing box 24 may have a seal assembly (not shown) for sealing against an outer surface of the polished portion 25*p* while accommodating rotation of the drive rod 25*d,p* relative to the stuffing box 24.

The tensioner 31 may exert tension 19*t* on the drive string 20*r* during operation of the ALS 20 to stabilize rotation of the drive string 20*r*, thereby obviating the need for stabilizers disposed along the drive string. The tension 19*t* may depend on parameters, such as a diameter of the continuous sucker rod 17 and the drive speed 16*o*. For a continuous sucker rod 17 having a diameter of between three quarters and one inch rotated at the drive speeds 16*o* discussed above, the tension 19*t* may range between five thousand and twenty-five thousand pounds or between seventy five hundred and fifteen thousand pounds. The tensioner 31 may include a cylinder 31*c*, a piston 31*p*, and a piston rod 31*r*. The linkage 29*f,g* may include a lug 29*g* connected to a bottom of the piston rod 31*r* and a hanger 29*f* connected to the slider 27*s* and having a hole formed therethrough for receiving the piston rod. The lug 29*g* may engage the hanger 29*f* for hoisting the slider 27*s* by the tensioner 31.

The piston 31*p* may be disposed in a chamber of the cylinder 31*c*, thereby dividing the chamber into an upper portion and a lower portion. A base of the cylinder 31*c* may rest on and be connected to the top plate 30*u*, such as by fasteners. The piston 31*p* may carry a seal (not shown) for engaging an inner surface of the cylinder 31*c* and a base of the cylinder may carry a seal (not shown) for engaging the piston rod 31*r*. The cylinder 31*c* may have upper and lower hydraulic ports formed through a wall thereof and in fluid communication with respective portions of the cylinder chamber. A hydraulic fitting may be connected to the cylinder 31*c* at each hydraulic port and each fitting may provide fluid communication between the respective port and a hydraulic conduit extending to the HPU. The piston 31*p* and piston rod 31*r* may be longitudinally movable 19*p* relative to the cylinder 31*c* in response to pressurization of the cylinder chamber by the injection of hydraulic fluid by the HPU. A stroke length of the cylinder 31*c* may be sufficient to exert the desired tension 19*t* onto the drive string 20*r*.

During operation of the ALS 20, the PLC may monitor the tension 19*t* exerted on the drive string 20*r* by the tensioner to ensure compliance with the desired tension. The PLC may measure the actual tension exerted on the drive string 20*r* using a load cell (not shown), such as a pressure sensor in fluid communication with the cylinder chamber lower portion or an instrument sub assembled as part of the drive rod and having a strain gage. The PLC may subtract weight of the drive string 20*r* from the load cell measurement to obtain the actual exerted tension. A technician may provide the PLC with the weight or with parameters for calculating the weight, such as diameter and length of the continuous sucker rod. The PLC may then adjust the pressure in the cylinder chamber lower portion if needed to bring the actual tension into conformance with the desired tension.

Figure 2B:
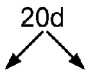
Figure 2B:
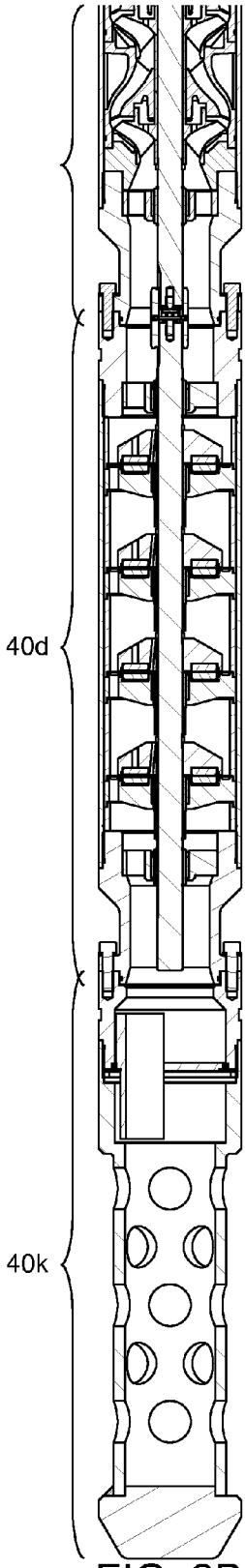

FIGS. 2A-C illustrate the downhole assembly 20*d*. The downhole assembly 20*d* may include a rod receptacle 40*r*, a tension chamber 40*u*, a pump 40*p*, a thrust chamber 40*d*, an intake 40*k*, one or more (four shown) sets of housing fasteners, such as bolts 47 (numerals in FIGS. 3A-4B), and one or more (two shown) shaft couplings 50 (numerals in FIGS. 3B-4B).

FIG. 3A illustrates the rod receptacle 40*r*. The rod receptacle 40*r* may include an adapter 41, a stopper 42, and an extended portion 43 of a shaft 44 of the tension chamber 40*u*. The rod coupling 34 may include a barrel 45 and a portion of a latch 46. A threaded coupling may be formed in an inner surface of the barrel 45 at an upper end thereof for connection to the lower end of the continuous sucker rod 17. Alternatively, the barrel 45 may be welded to the continuous sucker rod 17. A conical landing guide may be formed in an inner surface of the barrel 45 at a lower end thereof and the shaft extension 43 may have a complementary conical guide nose formed at an upper end thereof for receiving the landing guide to facilitate alignment of the rod coupling 34 with the receptacle shaft extension 43 when landing the rod coupling into the rod receptacle 40*r*. Engagement of the landing guide with the shaft extension 43 may even lift the rod coupling 34 from a bottom of the production tubing 12*t*.

A torsional profile (FIG. 5B), such as splines and splineways (not shown) or a polygonal shape (shown), may be formed along an inner surface of the barrel 45 at a lower portion thereof for mating with a complementary torsional profile formed along an outer surface of the shaft extension 43, thereby torsionally connecting the continuous sucker rod 17 to the tension chamber shaft 44 while allowing longitudinal movement of the barrel relative to the shaft extension to facilitate landing and engagement of the latch 46.

Alternatively, the shaft extension 43 may be a separate shaft connected to the tension chamber shaft 44. Alternatively, ribs (not shown) may be formed along an outer surface of the barrel 45 and spaced therearound. Flow passages may be formed between the ribs to minimize flow obstruction by the ribs. The ribs may facilitate alignment of the rod coupling 34 with the shaft extension 43 when landing the rod coupling into the rod receptacle 40*r*. A clearance formed between the ribs and an inner surface of the adapter 41 may be less than or equal to a clearance formed between the shaft extension 43 and a maximum diameter of the landing guide to ensure that the shaft extension is received by the landing guide. The rod coupling 34 may further have one or more relief ports (not shown) formed through a wall of the barrel 45 for exhausting debris during landing of the rod coupling 34 into the receptacle 40*r*.

The latch 46 may include a keeper groove 46*o*, a shearable fastener, such as a shear spring 46*s*, a lock groove 46*n*, and a cam 46*c*. The keeper groove 46*o* may be formed in an inner surface of the barrel 45 at a location between the landing guide and the torsional profile. The shear spring 46*s* may be elastically deformable between an expanded position and a contracted position and be biased toward the contracted position. The keeper groove 46*o* may be sized to carry the shear spring 46*s* therein in the contracted position and allow expansion thereof. The cam 46*c* may be a tapered shoulder formed in an outer surface of the shaft extension 43. The lock groove 46*n* may also be formed in the shaft extension outer surface adjacently below the cam 46*c*. As the rod coupling 34 is being lowered onto the shaft extension 43, the cam 46*c* may engage the shear spring 46*s* and force expansion thereof until the shear spring is aligned with the lock groove 46*n*. The shear spring may then contract into the lock groove 46*n*, thereby longitudinally fastening the sucker rod 17 to the tension chamber shaft 44 for the exertion of the tension 19*t* by the tensioner 31.

The shear spring 46*s* may be a canted coil spring (aka garter spring) configured to break at a threshold force greater than the desired tension 19*t* by an operating margin. The operating margin may be a fraction of the desired tension 19*t*, such as one-fifth, one-quarter, one-third, one-half, two-thirds, three quarters, or therebetween. For example, if the desired tension is fifteen thousand pounds and the margin is two-thirds, the threshold force would be twenty-five thousand pounds.

The adapter 41 may include an upper connector portion, a tubular mid portion, and a lower connector portion. The upper connector portion may flare outwardly from the mid portion and have a threaded coupling formed in an inner surface thereof for connection to the bottom of the production tubing 12*t*. A mating threaded coupling may be formed in an outer surface of the production tubing bottom. The upper connector portion may also have a fishing profile formed in an outer surface thereof to facilitate retrieval of the downhole assembly 20*d* in case the downhole assembly becomes stuck in the production wellbore 3*p* and cannot be removed using the production tubing 12*t*. The lower connector portion may have a flange formed in an outer surface thereof and a nose formed at a lower end thereof. The flange may have holes formed therethrough for receiving threaded fasteners, such as bolts 47. The nose may have a groove formed in an outer surface thereof for carrying a seal 48.

The stopper 42 may have an upper connector portion, a bore accommodating the shaft extension 43, a flow passage formed therethrough for accommodating pumping of the bitumen 8*p*, a landing shoulder for bumping of the rod coupling 34, and a lower connector portion. The upper connector portion may have a flange formed at an upper end thereof and a seal face formed in an inner surface thereof. The stopper 42 may have holes formed therethrough for receiving shafts of the adapter bolts 47, thereby fastening the flanges together and forming a longitudinal and torsional connection between the adapter 41 and the stopper. The seal face may receive the adapter nose and seal 48, thereby sealing the flanged connection. The lower connector portion may have a flange, a nose, and one of the seals 48, similar to those discussed above for the adapter 41. Alternatively, the stopper 42 may be integrated with the adapter 41 instead of being a separate member therefrom.

Figure 3B:
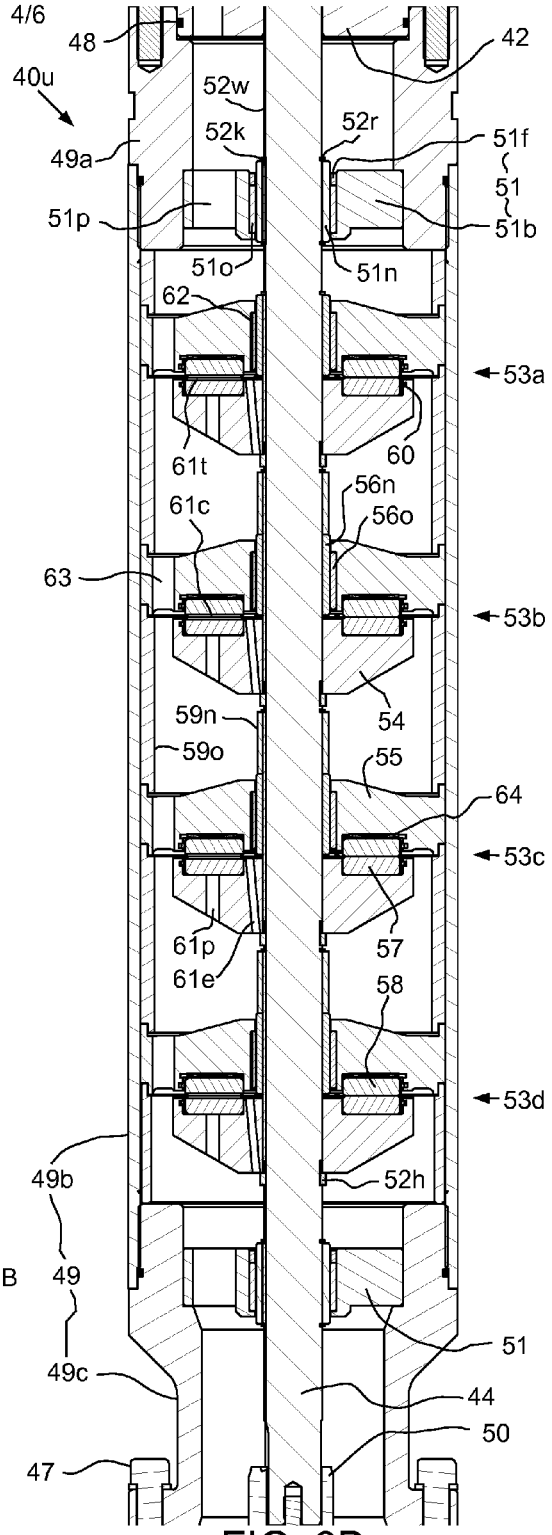
FIG. 3B illustrates a tension chamber of the downhole assembly.

FIG. 3B illustrates the tension chamber 40*u*. The tension chamber 40*u* may include a housing 49 and the shaft 44 disposed in the housing and rotatable relative thereto. To facilitate assembly, the housing 49 may include one or more sections 49*a-c*, each section longitudinally and torsionally connected, such as by threaded couplings and sealed by seals. Each housing section 49*a-c* may further be torsionally locked, such as by a tack weld (not shown). An upper connector section 49*a* may have a flange formed at an upper end thereof and a seal face formed in an inner surface thereof. The flange may have threaded sockets formed therein for receiving shafts of the adapter bolts 47, thereby fastening the adapter flange, stopper flange, and the upper tension flange together and forming a longitudinal and torsional flanged connection between the tension chamber 40*u*, the stopper 42, and the adapter 41. The seal face may receive the lower stopper flange nose and seal 48, thereby sealing the flanged connection. A lower connector portion 49*c* may have a flange, a nose, and one of the seals 48 similar to those discussed above for the adapter 41.

The tension chamber shaft 44 may be supported for rotation relative to the housing 49 by one or more (pair shown) radial bearings 51. Each radial bearing 51 may include a body 51*b*, an inner sleeve 51*n*, an outer sleeve 51*o*, and a fastener 51*f*. The sleeves 51*n,o* may be made from a wear-resistant material, such as a tool steel, nickel based alloy, ceramic, or ceramic-metal composite (aka cermet). The ceramic or cermet may be tungsten carbide. Each inner sleeve 51*n* may be longitudinally connected to the shaft 44 by retainers, such as snap rings 52*r*, engaged with respective grooves formed in an outer surface of the shaft 44, and torsionally connected to the shaft, such as by a key 52*k*. Each inner sleeve 51*n* may have a keyway formed in an inner surface thereof and the shaft 44 may have a keyway 52*w* formed along an outer surface thereof for receiving the respective key 52*k*. Each outer sleeve 51*o* may be torsionally connected to the bearing body 51*b*, such as by a press fit, and longitudinally connected to the bearing body by entrapment between a shoulder of the bearing body and the fastener 51*f*. Each bearing body 51*b* may be longitudinally and torsionally connected to the respective housing sections 49*a,c*, such as by a press fit. Each bearing body 51*b* may have a flow passage 51*p* formed therethrough for accommodating pumping of the bitumen 8*p* and the radial bearings 51 may utilize the pumped bitumen for lubrication.

The tension chamber 40*u* may further include one or more up-thrust bearings 53*a-d* and inner 59*n* and outer 59*o* spacers disposed between each up-thrust bearing. Each up-thrust bearing 53*a-d* may include a thrust driver 54, a thrust carrier 55, inner 56*n* and outer 56*o* radial bearing sleeves, a thrust disk 57, and a carrier pad 58. The thrust disks 57, carrier pads 58, and radial sleeves 56*n,o* may each be made from any of wear resistant materials, discussed above for the radial bearings 51. The radial sleeves 56*n,o* may be operable to radially support rotation of the thrust drivers 54 relative to the thrust carriers 55. The up-thrust bearings 53*a-d* may receive the tension 19*t* from the rotating drive string 20*r* and transfer the tension to the stationary production tubing 12*t* instead of the pump 40*p* via the housing 49, stopper 42, and the adapter 41.

Each thrust driver 54, inner radial sleeve 56*n*, and inner spacer 59*n* may be torsionally connected to the shaft 44, such as by a key 52*k* and the keyway 52*w*. Each thrust driver 54, inner radial sleeve 56*n*, and inner spacer 59*n* may be longitudinally connected to the shaft 44 by entrapment between a retainer, such as a shouldered snap ring 52*h*, engaged with a respective groove formed in an outer surface of the shaft 44 and a snap ring 52*r*. Each thrust disk 57 may be received in a recess formed in a top of the respective thrust driver 54. Each thrust disk 57 may be longitudinally retained in the respective recess by entrapment between the thrust driver 54 and the respective carrier pad 58. Each thrust disk 57 may be torsionally connected to the respective thrust driver 54 by a fastener, such as a torsion ring 60.

Each torsion ring 60 may be split and have a torsional profile, such as splines and splineways, formed in an inner surface thereof. Each thrust disk 57 may have mating spline and splineways formed in an outer surface thereof for mating with the torsion ring 60, thereby torsionally connecting the thrust disk and the torsion ring 60 while allowing longitudinal movement therebetween. Each torsion ring 60 may have lugs extending from an outer surface thereof and spaced therearound and the respective thrust driver 54 may have mating indentions formed in the respective recess. Each torsion ring 60 may be biased in an extended position such that the lugs extend into the indentions, thereby longitudinally and torsionally connecting the respective torsion ring and thrust driver 54.

Each thrust disk 57 may have a lubrication groove 61*t* formed in a bearing face thereof. The lubrication groove 61*t* may be radial (shown), tangential, angled, or spiral and may extend partially or entirely (shown) across the bearing face. Each thrust driver 54 may have a lubrication passage 61*p* formed therethrough in fluid communication with the recess. The thrust bearings 53*a-d* may utilize the pumped bitumen 8*p* for lubrication via the passages 61*p* and the grooves 61*t*. Each thrust driver 54 may further have a debris passage 61*e* formed therethrough for exhausting debris from a thrust interface between the thrust disk 57 and the carrier pad 58. Each lubrication passage 61*p* may be longitudinally straight and located at a midpoint of the respective recess. Each debris passage 61*e* may extend from a top of the respective thrust driver 57 adjacent to an inner surface of the respective thrust disk 57, along the thrust driver with a slight radially inward inclination, and to a bottom of the thrust driver adjacent an inner surface thereof. Each lubrication passage 61*p* may be aligned with the respective debris passage 61*e* and the lubrication groove 61*t* and each thrust driver 54 may include a plurality of lubrication passages 61*e,p* and grooves 61*t* spaced therearound.

The thrust carriers 55 may be longitudinally and torsionally connected to the housing 49 by compression between the upper 49*a* and lower 49*c* connector sections (and outer spacers 59*o*). Each outer radial sleeve 56*o* may be disposed in a cavity formed in an inner surface of the respective thrust carrier 55 and longitudinally connected thereto, such as by press fit. Each outer radial sleeve 56*o* may have a keyway formed in an outer surface thereof and each cavity may have a corresponding keyway formed therein for receiving a key 62, thereby torsionally connecting the respective outer radial sleeve and thrust carrier 55. Each thrust carrier 55 may also have a flow passage 63 formed therethrough adjacent to a periphery thereof for accommodating pumping of the bitumen 8*p*. Each thrust driver bottom may be tapered to direct the bitumen 8*p* toward an adjacent one of the flow passages 63 and each thrust carrier 55 may have a tapered top to transition discharge of the bitumen from the respective flow passage. Each carrier pad 58 may have one or more lubrication grooves 61*c* formed in a bearing face thereof corresponding to the respective thrust disk grooves 61*t*.

Each carrier pad 58 may be received in a recess formed in the respective carrier 55. Each carrier pad 58 may be torsionally connected to the respective thrust carrier 55 by a torsion ring 60. Each carrier pad 58 may be longitudinally biased into engagement with a respective thrust disk 57 by a set of compression springs, such as a Belleville springs 64, disposed in and spaced around an interface formed between the respective carrier pad and thrust carrier 55.

The tension chamber shaft 44 may include splines formed at and spaced around a lower portion thereof adjacent a bottom thereof, and a landing guide, such as a serration (not shown) formed in the bottom. The shaft coupling 50 may torsionally connect the tension chamber shaft 44 and a shaft 65 of the pump 40*p* and serve as a longitudinal stop for the tension chamber shaft. The shaft coupling 50 may include a tubular body having splines formed along and spaced around an inner surface thereof for mating with the tension chamber shaft splines. A guide profile, such as a serration (not shown), may be formed in top and bottom thereof and may interact with the tension shaft serration to orient the splines. A support, such as a pin, may extend across a bore of the coupling body. The pin may be longitudinally connected to the coupling body, such as by fasteners. The coupling body may have threaded holes formed through a wall thereof for receiving the fasteners and the pin may have a groove formed therein for receiving tips of the fasteners, thereby longitudinally connecting the pin and the body.

Figure 4A:
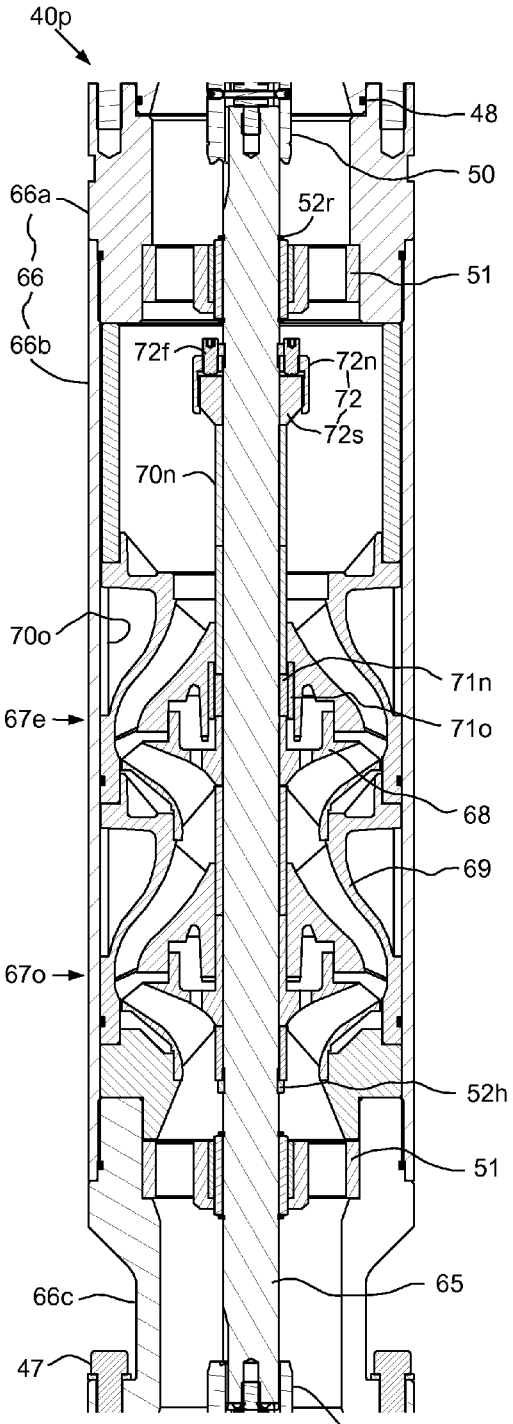
FIG. 4A illustrates a pump of the downhole assembly.

FIG. 4A illustrates the pump 40*p*. The pump 40*p* may include a housing 66 and the shaft 65 disposed in the housing and rotatable relative thereto. To facilitate assembly, the pump housing 66 may include one or more sections 66*a-c*, each section longitudinally and torsionally connected, such as by a threaded connection and sealed by a seal. Each housing section 66*a-c* may further be torsionally locked, such as by a tack weld (not shown). An upper connector section 69*a* may have a flange, a seal face, and threaded sockets formed therein similar to that of the tension chamber upper connector section 49*a*. A lower connector portion 69*c* may have a flange, a nose, and one of the seals 48, similar to those discussed above for the adapter 41.

The pump shaft 65 may have a keyway (not shown) formed along an outer surface thereof. The pump shaft 65 may be supported for rotation relative to the housing 66 by one or more (pair shown) of the radial bearings 51. The pump shaft 65 may also have splines formed at and spaced around upper and lower portions thereof adjacent a respective top and bottom thereof, and a landing guide, such as a serration (not shown) formed in the top and bottom for connection to the respective shaft coupling 50. A second one of the shaft couplings 50 may torsionally connect the pump shaft 65 and a shaft 74 of the thrust chamber 40*d* and serve as a longitudinal stop for the pump shaft.

The pump 40*p* may be centrifugal, such as a radial flow or mixed axial/radial flow centrifugal pump. The pump 40*p* may include one or more stages, such as one or more even stages 67*e* and as one or more odd stages 67*o*. Each stage 67*e,o* may include an impeller 68 a diffuser 69, and an impeller spacer 70*n*. Each even stage 67*e* may further include an inner radial bearing sleeve 71*n* torsionally connected to the pump shaft 65, such as by a key (not shown) and the keyway, and an outer radial bearing sleeve 71*o* longitudinally and torsionally connected to the respective diffuser 69, such as by a press fit. The radial sleeves 71*n,o* may be made from any of the wear resistant materials, discussed above for the radial bearings 51. Each impeller 68 and impeller spacer 70*n* may be torsionally connected to the pump shaft 65, such as by a key (not shown) and the keyway. The impellers 68 and impeller spacers 70*n* may be longitudinally connected to the pump shaft 65 by compression between a compression fitting 72 and a retainer, such as one of the shouldered snap rings 52*h*.

Alternatively, each odd stage 67*o* may include the radial sleeves 71*n,o* instead of the even stage 67*e* or each stage may include the radial sleeves.

The compression fitting 72 may include a sleeve 72*s*, a nut 72*n*, and one or more (pair shown) fasteners, such as set screws 72*f*. The compression fitting 72 may be longitudinally connected to the pump shaft 65, such as by one of the shouldered snap rings 52*h* and torsionally connected to the pump shaft, such as by a key (not shown) and the keyway. The sleeve 72*s* may have a threaded coupling formed in an outer surface thereof for receiving a threaded coupling formed in an inner surface of the nut 72*n*. Rotation of the nut 72*n* relative to the sleeve 72*s* may longitudinally drive the sleeve into engagement with one of the impeller spacers 70*n*, thereby compressing the impellers 68, radial sleeve 71*n*, and impeller spacers. Once tightened to a predetermined torque, the nut 72*n* may be torsionally connected to the compression sleeve 72*s* by installing or tightening the set screws 72*f*.

The diffusers 69 may be longitudinally and torsionally connected to the pump housing 66, such as by compression between the upper 66*a* and lower 66*c* connector sections (and diffuser spacers 70*o*). Rotation of each impeller 68 by the pump shaft 65 may impart velocity to the bitumen 8*p* and flow through the respective stationary diffuser 69 may convert a portion of the velocity into pressure. The pump 40*p* may deliver the pressurized bitumen 8*p* to the production tubing 12*t* via the tension chamber 40*u* and the rod receptacle 40*r*.

Figure 4B:
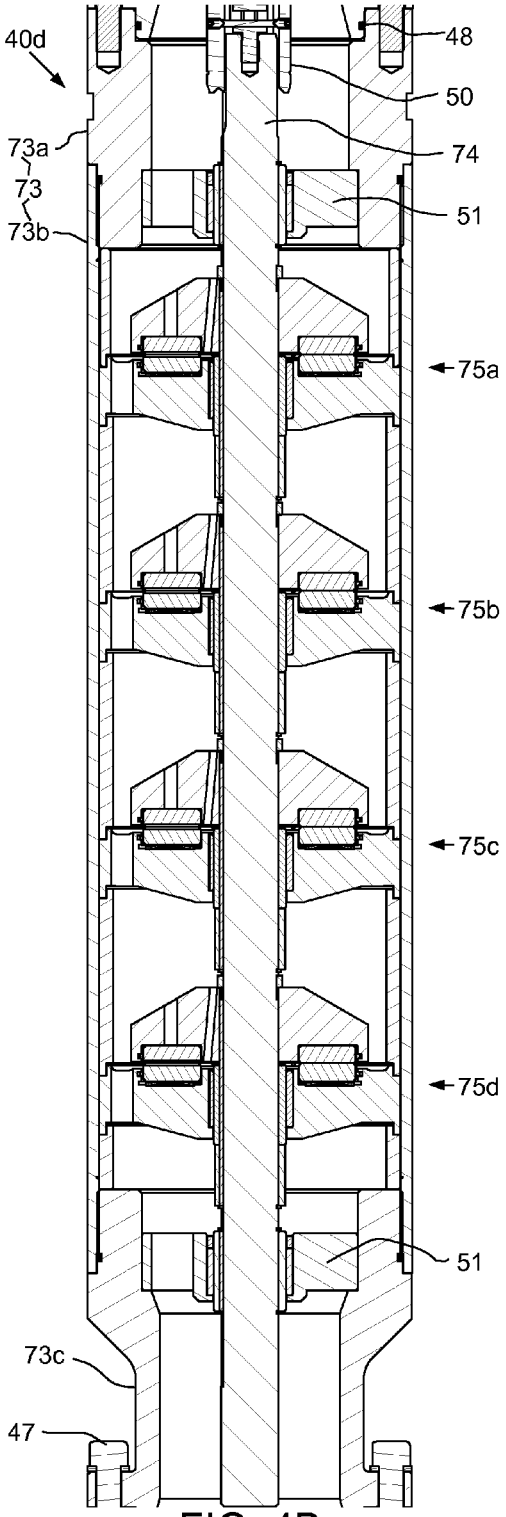
FIG. 4B illustrates a thrust chamber of the downhole assembly.

FIG. 4B illustrates the thrust chamber 40*d*. The thrust chamber 40*d* may include a housing 73 and the shaft 74 disposed in the housing and rotatable relative thereto. To facilitate assembly, the housing 73 may include one or more sections 73*a-c*, each section longitudinally and torsionally connected, such as by threaded couplings and sealed by seals. Each housing section 73*a-c* may further be torsionally locked, such as by a tack weld (not shown). An upper connector section 73*a* may have a flange, a seal face, and threaded sockets formed therein similar to that of the tension chamber upper connector section 49*a*. A lower connector portion 73*c* may have a flange, a nose, and one of the seals 48, similar to those discussed above for the adapter 41.

The thrust chamber shaft 74 may be supported for rotation relative to the housing 73 by one or more (pair shown) of the radial bearings 51. The thrust chamber 40*d* may further include one or more down-thrust bearings 75*a-d* and inner and outer spacers disposed between each down-thrust bearing. Except for being inverted, the down-thrust bearings 75*a-d* may be similar or identical to the up-thrust bearings 53*a-d*. The down-thrust bearings 75*a-d* may receive both impeller thrust and pressure thrust from the rotating pump shaft 65 via the respective shaft coupling 50 and be capable of transferring the thrusts to the stationary production tubing 12*t* via the housings 73, 66, 49, stopper 42, and adapter 41.

The production tubing 12*t* may be capable of sustaining both the compressive force exerted thereon by the tension chamber 40*u* and the tensile force exerted thereon by the thrust chamber 40*d* to allow flexibility in start-up and/or shutdown of the ALS 20. The production tubing 12*t* may have a weight substantially greater than the desired tension 19*t* to withstand the compressive force without buckling and a tensile strength sufficient to withstand the tensile force. Alternatively, the production tubing 12*t* may only need to be capable of withstanding a difference between the compressive force and the tensile force.

Figure 5A:
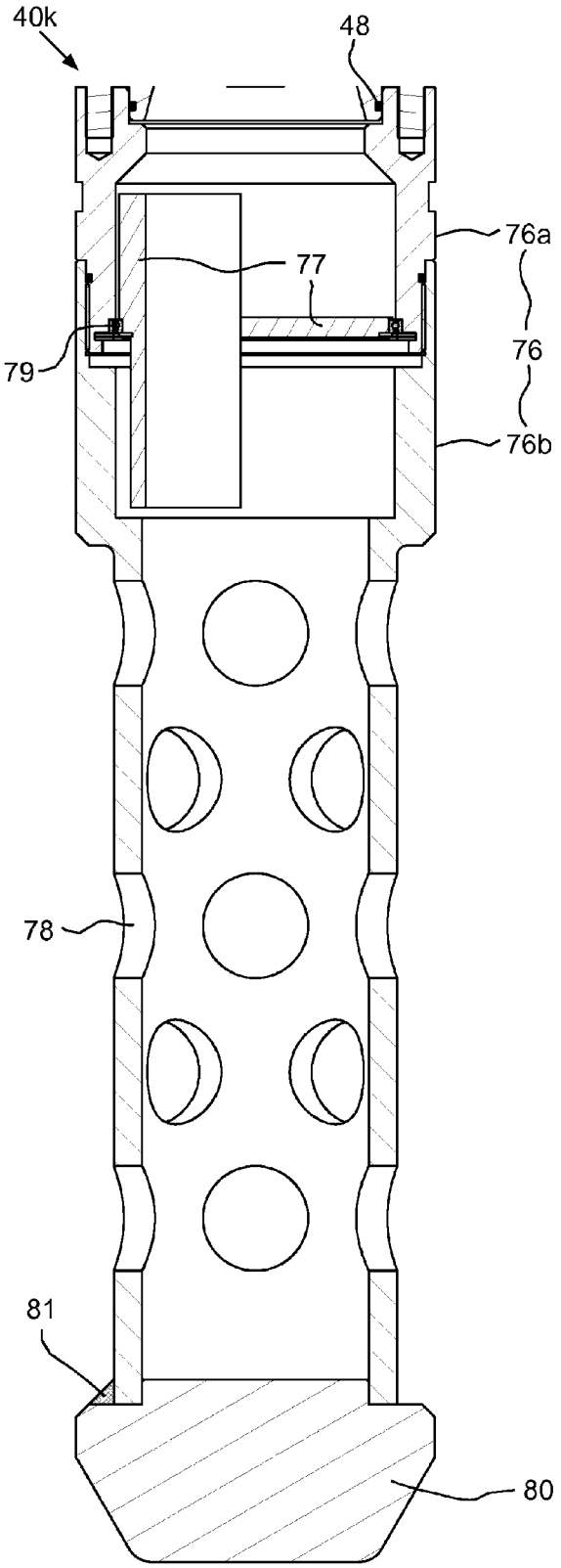
FIG. 5A illustrates an intake of the downhole assembly.
Figure 5B:
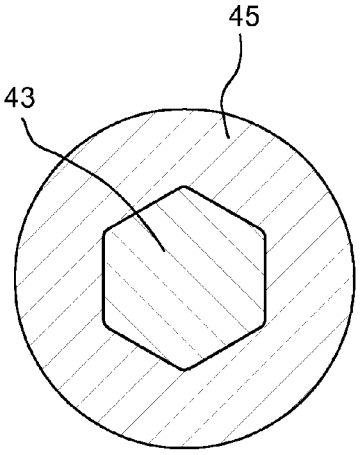
FIG. 5B further illustrates the rod receptacle.

FIG. 5A illustrates the intake 40*k*. The intake 40*k* may include a housing 76 and a feeder 77 disposed in the housing and rotatable relative thereto. To facilitate assembly, the housing 76 may include one or more sections 76*a,b*, each section longitudinally and torsionally connected, such as by threaded couplings and sealed by seals. Each housing section 76*a,b* may further be torsionally locked, such as by a tack weld (not shown). An upper connector section 76*a* may have a flange, a seal face, and threaded sockets formed therein similar to that of the tension chamber upper connector section 49*a*. A lower housing section 76*b* may have one or more (five shown) rows, each row having one or more ports 78 formed through a wall thereof for receiving the bitumen 8*p* from the production wellbore 3*p*. The rows of ports 78 may be formed along and spaced around the lower housing section 76*b*. The feeder 77 may have a plate portion and a tube portion located at a periphery of the feeder. The plate portion may obstruct a bore of the housing 76 to direct flow of the bitumen 8*p* through the tube portion.

The feeder 77 may be supported for rotation relative to the housing 401 by a radial bearing 79. The radial bearing 79 may be rolling element bearing, such as a ball bearing. When the downhole assembly 20*d* is deployed in the horizontal portion of the production wellbore 3*p*, the peripheral location of the feeder tube portion may create eccentricity, thereby causing the feeder 77 to rotate relative to the housing 76 such that the tube portion is adjacent to a lower surface of the production wellbore 3*p*. This location may utilize a natural separation effect in the production wellbore 3*p* such that a bore of the feeder tube portion intakes the bitumen 8*p* rather than steam vapor or other gas.

The downhole assembly 20*d* may further include a guide shoe 80. The guide shoe 80 may be connected to the lower housing section 76*b*, such as by a tack weld 81. The guide shoe 80 may close a bottom of the intake 40*k* and have a tapered outer surface to facilitate deployment of the downhole assembly 20*d* into the production wellbore 3*p*.

Figure 6:
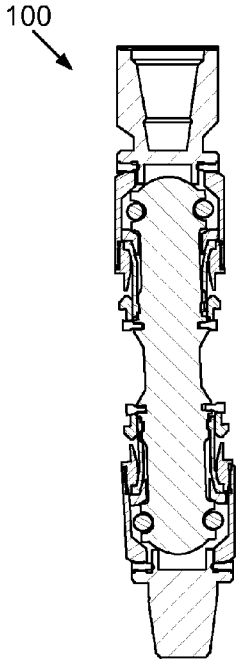
FIG. 6 illustrates an optional constant velocity joint for use with a drive string of the ALS.

FIG. 6 illustrates an optional constant velocity joint 100 for use with a drive string 20*r*. The constant velocity joint 100 may have threaded couplings formed at each end thereof for interconnection as part of the drive string 20*r*. The constant velocity joint 100 may be located between the lower end of the drive string 20*r* and the rod coupling 34. The constant velocity joint 100 may allow flexing of the drive string 20*r* between the continuous sucker rod 17 and the rod coupling 34 to avoid exertion of excess bending moment on the shaft extension 43, especially during startup.

While the foregoing is directed to embodiments of the present disclosure, other and further embodiments of the disclosure may be devised without departing from the basic scope thereof, and the scope of the invention is determined by the claims that follow.

The invention claimed is:

1. A downhole assembly of an artificial lift system, comprising:

an adapter for connection to production tubing;

a receptacle shaft having a latch profile for receiving a latch fastener of a drive coupling and a torsional profile for mating with the coupling to longitudinally and torsionally connect thereto;

an up-thrust bearing comprising:

a thrust driver longitudinally and torsionally connected to the receptacle shaft; and a thrust carrier connected to the adapter;

a centrifugal pump comprising:

a diffuser connected to the adapter;

a pump shaft torsionally connected to the receptacle shaft; and an impeller connected to the pump shaft; and a down-thrust bearing comprising:

a thrust driver longitudinally and torsionally connected to the pump shaft; and a thrust carrier connected to the adapter.

2. The downhole assembly of claim 1, wherein each thrust bearing is in fluid communication with a pumped fluid path for lubrication thereof.

3. The downhole assembly of claim 2, wherein each thrust bearing further comprises:

a thrust disk torsionally connected to the respective thrust driver;

a carrier pad torsionally connected to the respective thrust carrier; and a spring biasing the carrier pad into engagement with the thrust disk.

4. The downhole assembly of claim 3, wherein:

each of the thrust disk and carrier pad has a lubrication groove formed in a bearing face thereof, and each thrust driver has:

a lubrication passage formed therethrough, and a debris passage formed therethrough.

5. The downhole assembly of claim 3, wherein each thrust disk and each carrier pad are made from tool steel, nickel based alloy, ceramic, or cermet.

6. The downhole assembly of claim 3, wherein each thrust bearing further comprises:

an inner radial bearing sleeve torsionally connected to the respective thrust driver, and an outer radial bearing sleeve torsionally connected to the respective thrust carrier.

7. The downhole assembly of claim 3, wherein each thrust bearing further comprises:

a first torsion ring longitudinally and torsionally connected to the respective thrust driver and torsionally connected to the respective thrust disk, and a second torsion ring longitudinally and torsionally connected to the respective thrust carrier and torsionally connected to the respective carrier pad.

8. The downhole assembly of claim 2, wherein:

each thrust carrier has a pumped fluid passage formed therethrough adjacent to a periphery thereof, a bottom of the up-thrust driver is tapered to direct fluid toward the respective pumped fluid passage, and a top of the up-thrust carrier is tapered top to transition discharge of the pumped fluid from the pumped fluid passage.

9. The downhole assembly of claim 1, further comprising an intake, comprising:

a housing connected to the adapter and having one or more ports formed through a wall thereof; and a feeder having a plate portion and a tube portion located at a periphery of the feeder, the plate portion obstructing a bore of the housing to direct fluid through the tube portion; and a radial bearing supporting the feeder for rotation relative to the housing.

10. An artificial lift system (ALS), comprising:

the downhole assembly of claim 1; and the drive coupling comprising a barrel having:

a coupling formed at an upper end thereof for connection to a drive string, a torsional profile formed in an inner surface thereof for mating with the receptacle shaft torsional profile, a keeper groove formed in the inner surface thereof for carrying the latch fastener, and a landing guide formed in a lower end thereof.

11. The ALS of claim 10, further comprising a constant velocity joint having a threaded coupling formed at a lower end thereof for connection to the drive coupling and a threaded coupling formed at an upper end thereof for connection to the drive string.

12. The ALS of claim 10, further comprising a drive head, comprising:

a motor for rotating the drive string at a speed greater than or equal to 1,000 RPM;

a clamp for connection to an upper end of the drive string;

a thrust bearing for supporting the clamp;

a stabilizer carrying the thrust bearing and torsionally connecting the thrust bearing to a stationary frame while allowing longitudinal movement of the thrust bearing relative to the frame; and a tensioner for hoisting the stabilizer during operation of the ALS, thereby exerting tension on the drive string for stabilization thereof.

13. A method of pumping production fluid from a wellbore, comprising:

landing a drive string onto a shaft of a downhole assembly disposed in the wellbore and fastening the drive string to the shaft, wherein the downhole assembly comprises a tension chamber, a centrifugal pump, and a thrust chamber; and pumping production fluid from the wellbore by:

operating a motor of a drive head at surface, thereby rotating the drive string at a speed greater than or equal to 800 RPM and driving an impeller of the centrifugal pump; and operating a tensioner of the drive head to exert tension on the shaft, thereby stabilizing the drive string.

14. The method of claim 13, wherein:

the wellbore is a production wellbore traversing a hydrocarbon bearing formation, and the method further comprises heating the formation or diluting the hydrocarbons thereof, and the production fluid is hydrocarbon drainage from the formation.

15. The method of claim 14, wherein the formation is heated by injecting steam into an injection wellbore traversing the formation.

16. The method of claim 13, wherein an up-thrust bearing of the tension chamber and a down-thrust bearing of the thrust chamber are lubricated by the production fluid.

17. The method of claim 13, wherein the tension is between 5,000 and 25,000 pounds.

18. The method of claim 13, wherein the speed is less than 2,500 RPM.

19. The method of claim 13, wherein the tension on the shaft is greater than a weight of the drive string.

20. The method of claim 13, further comprising transferring the tension from the shaft to the tension chamber.

* * * * *